US009051077B2

(12) United States Patent
Justice

(10) Patent No.: US 9,051,077 B2
(45) Date of Patent: Jun. 9, 2015

(54) FRONT-ROLLOVER AND HAMMER-LOCK CONTAINER

(71) Applicant: INTERNATIONAL PAPER COMPANY, Memphis, TN (US)

(72) Inventor: Timothy J. Justice, Williston, TN (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 14/341,180

(22) Filed: Jul. 25, 2014

(65) Prior Publication Data

US 2015/0028090 A1 Jan. 29, 2015

Related U.S. Application Data

(60) Provisional application No. 61/858,962, filed on Jul. 26, 2013.

(51) Int. Cl.
*B65D 5/66* (2006.01)
*B65D 5/22* (2006.01)

(52) U.S. Cl.
CPC ..... *B65D 5/6652* (2013.01); *B65D 5/6626* (2013.01); *B65D 5/665* (2013.01); *B65D 5/6676* (2013.01); *B65D 5/6658* (2013.01); *B65D 5/22* (2013.01)

(58) Field of Classification Search
CPC ..... B65D 5/0005; B65D 5/22; B65D 5/665; B65D 5/6652; B65D 5/6626; B65D 5/6676; B65D 21/0233; B65D 21/0234
See application file for complete search history.

(56) References Cited

U.S. PATENT DOCUMENTS

| | | | | |
|---|---|---|---|---|
| 1,192,168 | A | | 7/1916 | Cook |
| 1,302,361 | A | | 4/1919 | Gordon |
| 1,383,148 | A | | 6/1921 | Pinkerton |
| 1,525,360 | A | | 2/1925 | Blandford |
| 1,530,644 | A | | 3/1925 | Blandford |
| 1,791,196 | A | | 2/1931 | Deutschmeister |
| 1,824,927 | A | | 9/1931 | Powell |
| 1,869,724 | A | | 8/1932 | Wallace |
| 1,895,070 | A | | 1/1933 | Czerweny |
| 2,251,565 | A | * | 8/1941 | Forman ..... 229/146 |
| 2,308,818 | A | | 1/1943 | Levkoff |
| 2,938,623 | A | | 5/1960 | Eichorn |
| 2,942,770 | A | | 6/1960 | Eichorn |
| 3,010,635 | A | | 11/1961 | Sheldon-Williams |
| 3,088,651 | A | | 5/1963 | Rasmusson |

(Continued)

FOREIGN PATENT DOCUMENTS

| | | |
|---|---|---|
| AU | 2009100873 | 10/2009 |
| DE | 202008011370 | 11/2008 |

(Continued)

*Primary Examiner* — Gary Elkins
(74) *Attorney, Agent, or Firm* — Matthew M. Eslami

(57) ABSTRACT

A front-rollover-style and hammer lock shipping container formed from a one-piece unitary blank of material which comprises a bottom wall foldably joined to upstanding opposed parallel side walls, a back wall, and a front wall to form an interior space. A top wall is foldably joined to the back wall. The bottom wall comprises two front slots each of which is formed on longitudinal edge in proximity of the front wall. The front wall comprises two wall panels being coextensively in overlapping relationship wherein one of the front wall panels includes a pair of front locking tabs spaced apart from one another that are engaged with the respective two front slots when the container is fully constructed.

2 Claims, 7 Drawing Sheets

(56) References Cited

U.S. PATENT DOCUMENTS

| | | | | | |
|---|---|---|---|---|---|
| 3,385,424 | A | | 5/1968 | Thompson et al. | |
| 3,395,850 | A | | 8/1968 | Kotowick | |
| 3,581,976 | A | | 6/1971 | Burgess | |
| 3,801,000 | A | | 4/1974 | Hurley et al. | |
| 3,889,868 | A | | 6/1975 | Bruckner et al. | |
| 4,168,028 | A | | 9/1979 | McCall | |
| 4,197,980 | A | | 4/1980 | Johnson | |
| 4,375,263 | A | | 3/1983 | Dworkin | |
| 4,436,206 | A | | 3/1984 | Kuchenbecker | |
| 4,452,367 | A | * | 6/1984 | Wein | 229/101 |
| 4,537,344 | A | | 8/1985 | Thomas | |
| 4,620,666 | A | | 11/1986 | Lacasa et al. | |
| 4,702,409 | A | | 10/1987 | Osborne | |
| 4,795,085 | A | * | 1/1989 | Wein | 229/117.03 |
| 4,844,331 | A | | 7/1989 | Oldfather | |
| 5,139,195 | A | | 8/1992 | McClure | |
| 5,209,392 | A | * | 5/1993 | Anatro | 229/117.01 |
| 6,032,853 | A | | 3/2000 | Chevalier | |
| 6,402,020 | B1 | | 6/2002 | McClure | |
| 6,685,085 | B2 | * | 2/2004 | Hanna | 229/148 |
| 6,840,437 | B2 | | 1/2005 | Chen | |
| 7,234,629 | B2 | | 6/2007 | Ho | |
| 8,783,551 | B2 | | 7/2014 | Mcclure | |
| 2003/0234252 | A1 | | 12/2003 | Howard | |
| 2007/0194093 | A1 | * | 8/2007 | Ford | 229/144 |
| 2007/0267471 | A1 | * | 11/2007 | Falana | 229/240 |
| 2011/0253772 | A1 | | 10/2011 | Holch et al. | |
| 2011/0259899 | A1 | | 10/2011 | McClure | |

FOREIGN PATENT DOCUMENTS

| | | |
|---|---|---|
| FR | 2502120 | 9/1982 |
| FR | 2510970 | 2/1983 |
| WO | 2008084183 | 7/2008 |

* cited by examiner

FRONT-ROLLOVER AND HAMMER-LOCK CONTAINER

CROSS REFERENCE TO RELATED APPLICATIONS

This application claims priority to U.S. provisional patent application Ser. No. 61/858,962, filed on 26 Jul. 2013, which is hereby incorporated hereinto by reference as if fully restated herein.

FIELD OF THE INVENTION

The present invention relates generally to a shipping container formed from a one-piece unitary blank of material, and more particularly, to a front-rollover-style shipping container having self-locking features and a tray style depth and requires no specialized equipment for assembly.

BACKGROUND OF THE INVENTION

It is a common practice in meat or poultry industry to pack their meat or poultry patty in a paperboard container. Previously, the corrugated paperboard grade was reduced on a one-piece front-rollover-style meat or poultry patty container or tray to the point that it was failing across the back of the container, and also at the back of the cover plate. To solve this problem without increasing the cost, the alternative containers or trays had to be stronger across the back side. The front-rollover-style container up until now had the smallest blank size for shallow-size hand-set container and rapid hand-set-up, which have been its strength. However, this container has drawbacks such as the long-corrugated blank size gives fewer trim options off of the corrugators, and that it was about twice as strong across the front of the container as it was across its back. This drawback causes problems in containers or trays column-stacked on a pallet, where the strong front of the bottom container serves as fulcrum point, and the stack will progressively tip toward the weak side, with undesirable results.

Therefore, it is desirable to provide a front-rollover-style shipping container having self-locking features and a tray style depth which can be easily manufactured on standard manufacturing and erecting equipment.

SUMMARY OF THE INVENTION

The present invention relates to a container having a tray style depth and self-locking features and requires no specialized equipment for assembly. The present container's configuration is called a front-rollover-style and hammer lock shipping container. In the claimed invention, the front wall comprises of two panels coextensively overlapped with one another via two score lines which saves substantial set-up time of the container as well as having a smaller blank size which translates into material savings. In addition, the respective dust flaps of the lid include nicks to hold them aligned with the side wall panels of the container. This feature permits the containers to nest and be column-stacked for storage prior to being used. The lid is locked into position by a tucked-in flap so that when the container travels through chutes, the lid does not accidently open and jams the passageway, causing lost productivity. The present container has a smaller foot print when compared to the previously used container. The phrase "Hammer-lock" generally means that due to the structure of the locking feature of the container, it is the hard edge of the hammer-lock panel that makes lock up contact with its matching slot. The present invention is substantially similar to the U.S. Pat. No. 8,783,551, the disclosure of which is incorporated in full herein by reference and it is owned by the same assignee. The present invention contains all of the advantages and alterations that are denoted in the U.S. Pat. No. 8,783,551 and are not repeated again to avoid redundancy.

Accordingly, the present invention is directed to a front-rollover style and hammer-lock shipping container formed from a one-piece unitary blank of material. The container comprises a bottom wall foldably joined to upstanding opposed parallel side walls, a back wall, and a front wall to form an interior space. A top wall is foldably joined to the back wall. The top wall panel includes two identical dust flaps each of which foldably extend from respective lateral edges thereof. Each of the dust flaps includes a respective dust locking tab formed at respective free edges. Each of the respective opposed parallel side walls includes respective first and second flanges and respective third and fourth flanges each of which extend from a respective lateral sides thereof. The respective dust flaps and the respective opposed parallel side walls are attached to one another by two nicks. Each of the nicks is formed between the respective lateral edge of the dust flaps and the respective second and fourth flanges so that the partially folded containers be capable of being column-stacked. The bottom wall comprises first and second front slots each of which is formed on a longitudinal edge in proximity of the front wall. The front wall comprises two wall panels being coextensively in overlapping relationship with one another. One of the front wall panels includes two front locking tabs each of which being engaged with the corresponding first and second front slots when the container is fully constructed. Another aspect of the present invention relates to one-piece unitary blank for making a container used for shipping a plurality of articles. The blank comprises a bottom wall panel having a front edge, a back edge, and opposite side edges defined by respective transverse and longitudinal fold lines. The bottom wall panel comprises two front slots and two back slots formed on respective front edge and side edges. A top wall panel having a front edge, a back edge and opposite side edges defined by respective transverse and longitudinal fold lines. The top wall panel comprises a pair of opposed dust flaps each of which foldably joined to respective lateral edges of the top wall. Each of the dust flaps includes a respective dust locking tabs formed at respective free edges thereof. The top wall further includes a tucked-in flap that foldably extends from longitudinal free edge thereof. A back wall panel is foldably joined between the back edges of the bottom wall panel and the top wall panel. The respective dust flaps and the respective opposed parallel side walls are attached to one another by two nicks. A double front wall panels is formed by two score lines. The double front wall panels includes a front edge, a back edge, and opposite side edges in which the back edge of the front wall panels is foldably joined to the bottom wall panel. One of the front wall panel includes two front locking tabs that extend from the free edge thereof and are spaced apart from one another.

The respective front locking tabs are inserted into the respective front slots when the front wall panel (104*b*) is overlapped coextensively and in fully folded position with the front wall panel (104*a*) through the two parallel score lines.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
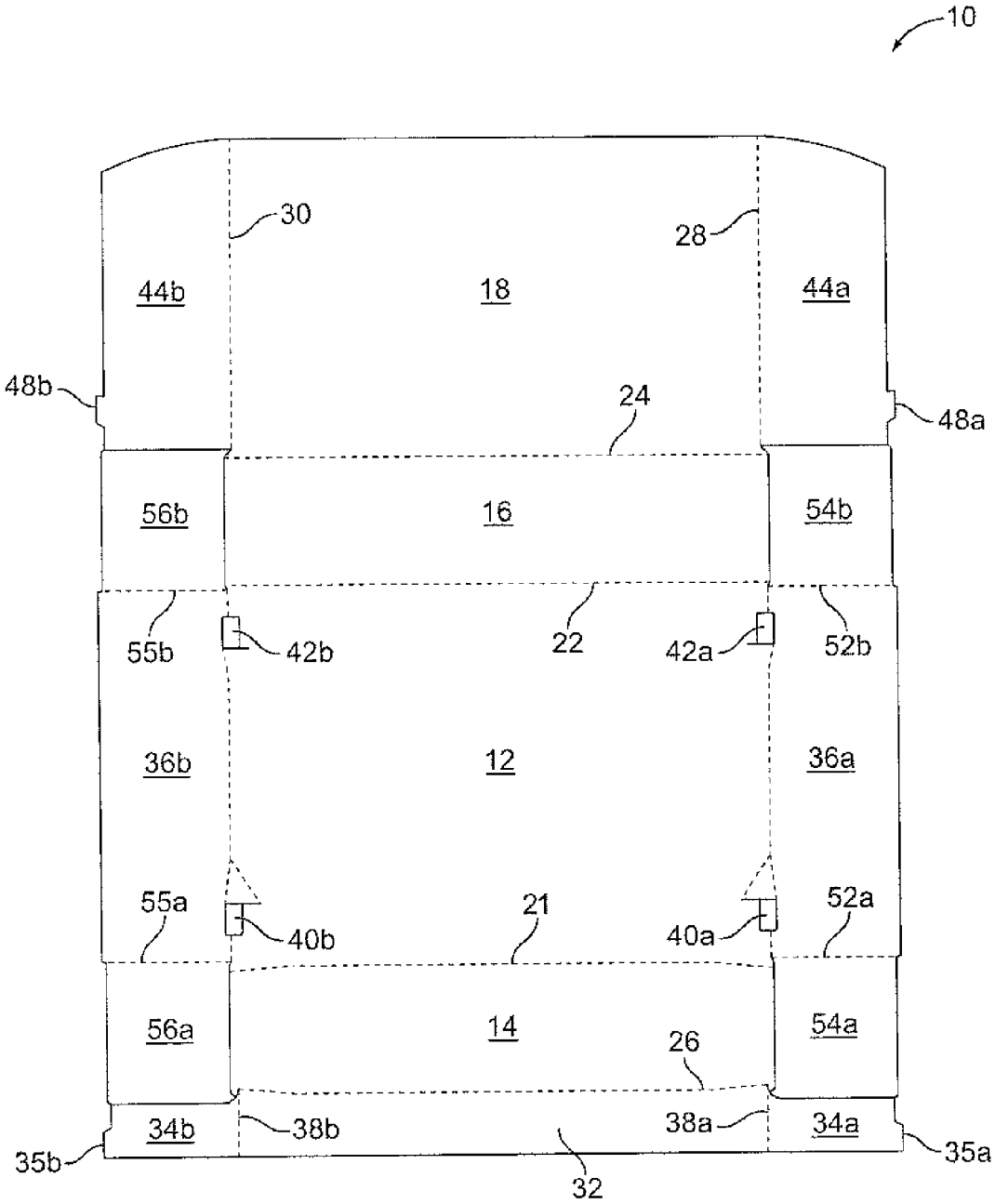
FIG. 1 (Prior Art)
FIG. 1 is a plan view of a prior art paperboard blank for forming a hammer-lock container.
Figure 2:
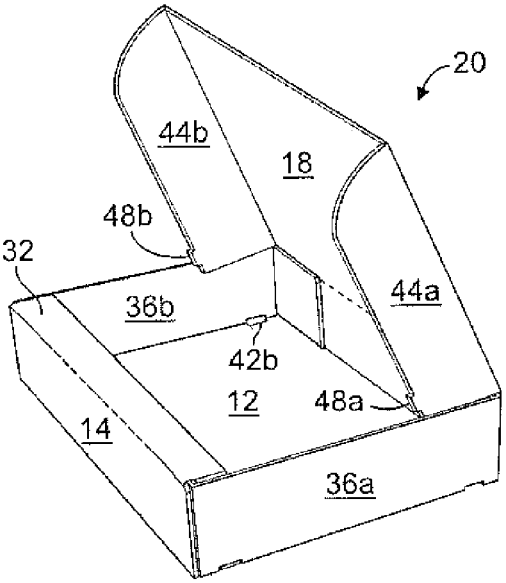
FIG. 2 (Prior Art)
FIG. 2 is a perspective view of a prior art container constructed from the blank in FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. With respect to phrase "Hammer-lock" generally means that due to the structure of the locking feature of the container, it is the hard edge of the hammer-lock panel that makes lock up contact with its matching slot. In addition, the phrase "Front-rollover-style" generally means that the front wall of the container comprises of two panels coextensively overlapped with one another via score lines or fold lines FIG. 1 is a plan view of a prior art paperboard blank for forming a hammer-lock container and FIG. 2 is a perspective view of a prior art container constructed from the blank in FIG. 1. The The blank 10 is divided into front wall panel 14, side wall panels 36*a*, 36*b*, bottom wall panel 12, back wall panel 16 panels and an optional top wall panel 18 by three transverse parallel fold lines 21, 22, and 24. The blank 10 is further divided by two longitudinal parallel fold lines 28, 30. The bottom wall panel 12 comprises a front edge, a back edge, and opposite side edges defined by respective transverse and longitudinal fold lines 21, 22, 24, 28, and 30. The front wall panel 14 is defined by fold line 21. A front wall panel 14 comprises a front edge, a back edge, and opposite side edges in which the back edge of the front wall is foldably joined to the bottom wall panel. The detail description of the blank 10 and the folding sequences of the blank 10 to form the container 20 in FIG. 2 can be found in U.S. Pat. No. 6,402,020, the disclosure of which is incorporated in full herein by reference and is not repeated again to avoid redundancy. The differences between the container 20 and the present invention is that the front wall comprises of two panels coextensively overlapped with one another via two score lines which saves substantial set-up time of the container as well as having a smaller blank size which translates into material savings. In addition, the respective dust flaps of the lid include nicks to hold them aligned with the side wall panels of the container. This feature permits the containers to nest and be column-stacked for storage prior to being used. The lid is locked into position by a tucked-in flap so that when the container travels through chutes, the lid does not accidently open and jams the passageway, causing lost productivity. Moreover, the present container has a smaller foot print when compared to the previously used container.

Figure 3:
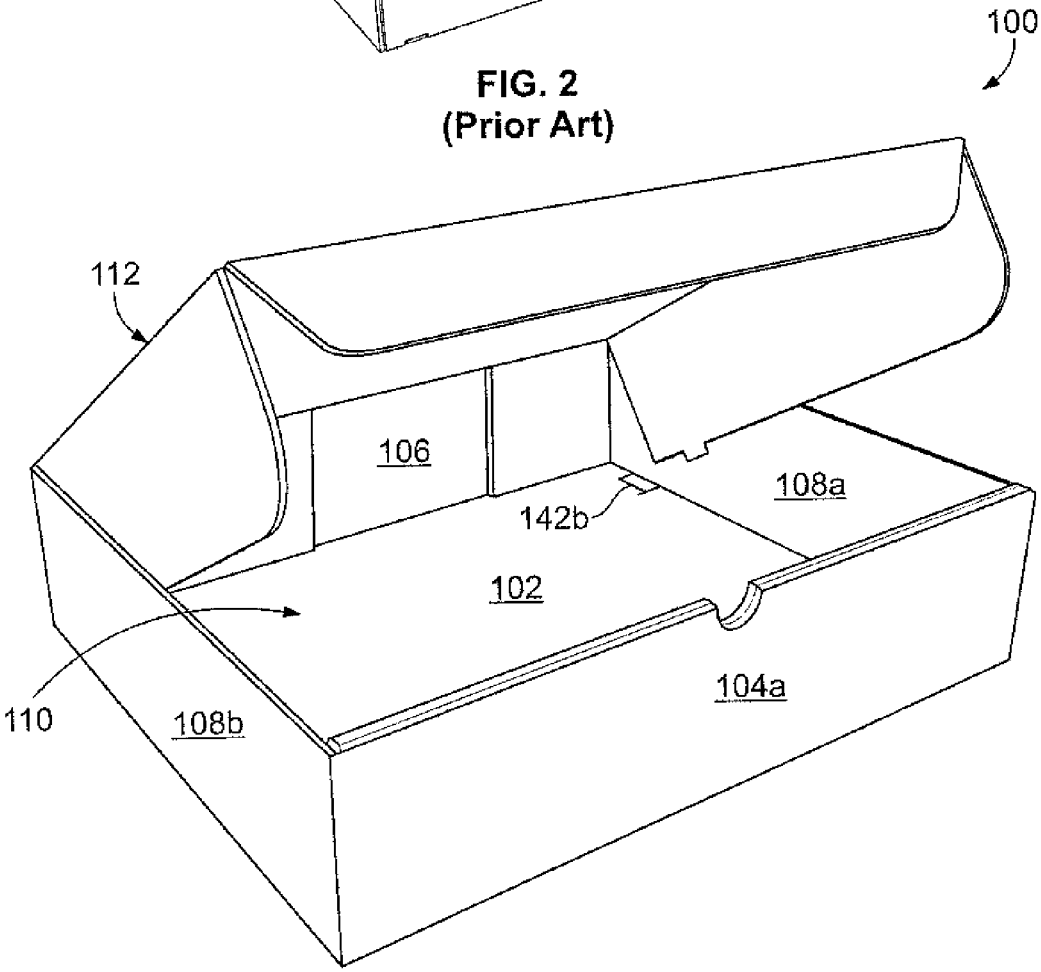
FIG. 3 is a perspective view of a front-rollover and hammer-lock container in accordance to a preferred embodiment of the present invention.

FIG. 3 is a perspective view of a front-rollover and hammer lock container 100 in accordance to a preferred embodiment of the present invention. The container 100 comprises a bottom wall 102 having a double front wall panels 104*a*, 104*b*, back wall 106, and opposed side walls 108*a*, 108*b* all of which foldably joined thereto. The front wall 104*a*, back wall 106, and the opposed side walls 108*a*, 108*b* extend upwardly from the bottom wall 102 to form an interior space 110. Moreover, a lid 112 is foldably joined to the back wall 106 to enclose the interior space 110. Since the back wall 106 and the side walls 108*a*, 108*b* has low profiles, then the container 100 resembles a tray-style container.

Figure 4:
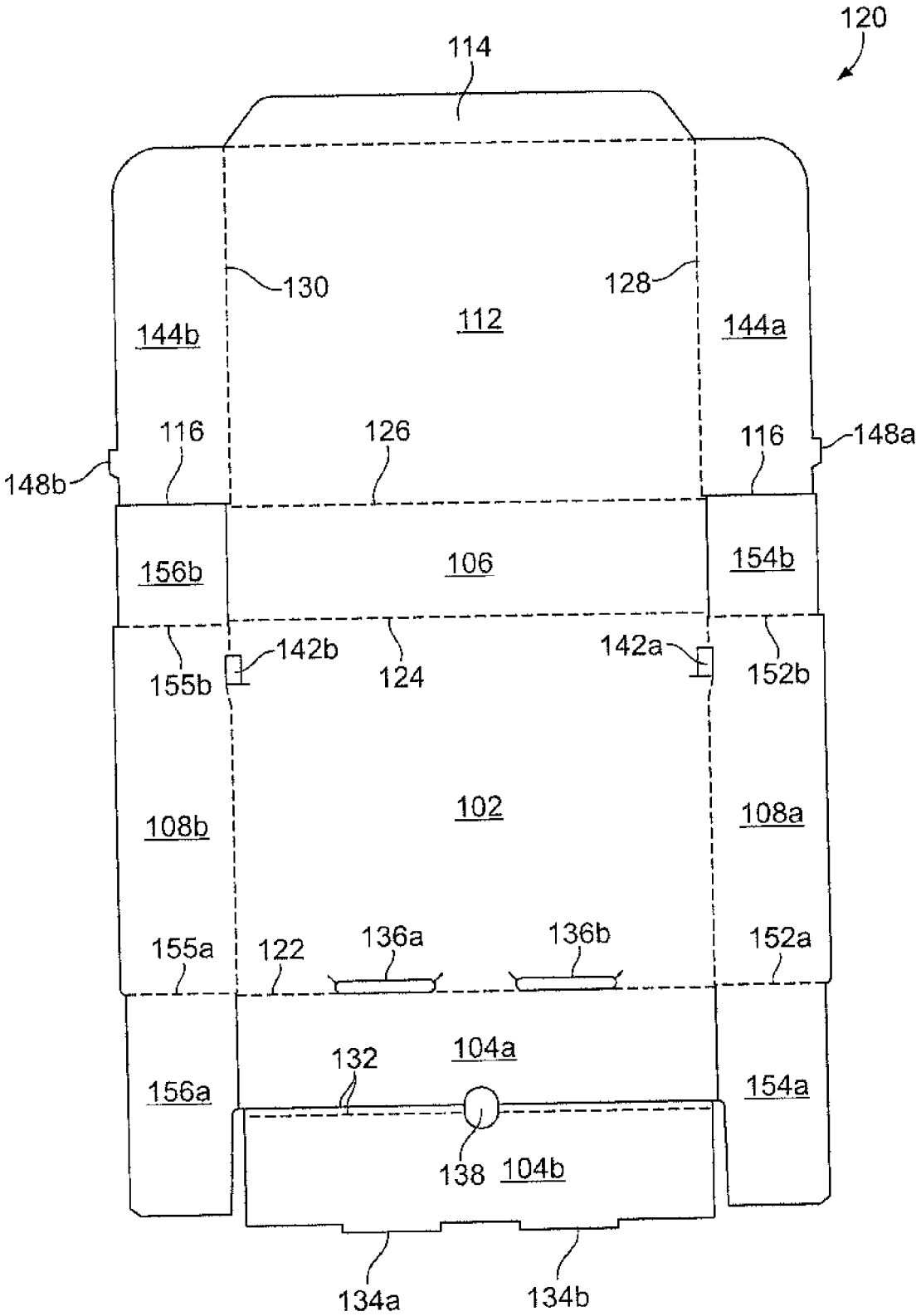
FIG. 4 is a plan view of a cut and scored paperboard blank for forming the front-rollover and hammer-lock container of FIG. 3 in accordance to a preferred embodiment of the present invention.

FIG. 4 is a plan view of a cut and scored paperboard blank 120 for forming the front-rollover and hammer lock container 100 depicted in FIG. 3 in accordance to the preferred embodiment of the present invention. The blank 120 is substantially flat symmetrical with respect to its longitudinal axis thereof. The blank 120 is preferably an integral piece of a material such as continuous sheet of conventional corrugated paperboard. The blank 120 is cut along its outer margins to form its specific shape. The blank 120 is divided into a double front wall panels 104*a*, 104*b*, opposed side wall panels 108*a*, 108*b*, bottom wall panel 102, back wall panel 106, and a top wall panel 112 by three transverse parallel fold lines 122, 124, and 126. The blank 120 is further divided by two longitudinal parallel fold lines 128, 130. The bottom wall panel 102' comprises a front edge, a back edge, and opposite side edges defined by respective transverse and longitudinal fold lines 122, 124, 128, and 130. Although the blank 120 is characterized as having side panels and end panels, but one of the ordinary skilled in the art would appreciate that the end panels can be defined as side panels too and the characterization of the side wall panels and/or end wall panels have no effect on the function or utility of the blank 120.

The front wall panels 104*a*, 104*b* are defined by two parallel score lines 132. The front wall panels 104*a*, 104*b* comprise a front edge, a back edge, and opposite side edges in which the back edge of the front wall is foldably joined to the bottom wall panel 102. The back wall panel 106' is defined by fold lines 124, 126 and the top wall panel 112' is defined by fold line 126. The bottom wall panel 102' and top wall panel 112' are spaced apart from one another by the back wall panel 106'. Two front slots 136*a*, 136*b* are formed at near fold line 122 and they are spaced apart from one another. The front wall panel 104*b* includes two front locking tabs 134*a*, 134*b* that extend from the free edge thereof and are spaced apart from one another. The respective front locking tabs 134*a*, 134*b* are inserted into the respective front slots 136*a*, 136*b* when the front wall panel 104*b'* is overlapped coextensively and in fully folded position with the front wall panel 104*a'* through the two parallel score lines 132. A cut out 138 is formed in the middle of the two parallel score lines 132 that is used to push up the lid 112 with an index finger of a user when the container 100 is in closed position.

Two opposed parallel side panels 108*a*, 108*b* are defined by respective fold lines 128, 130 and integrally extend from the respective lateral side of the bottom panel 102'. Each of the opposed side wall panels 108*a*', 108*b*' includes corresponding first and second flanges 154*a*, 154*b*, third and fourth flanges 156*a*, 156*b* each of which extend from the respective lateral sides thereof. The first, second flanges 154*a*, 154*b* and third, fourth flanges 156*a*, 156*b* are defined by respective fold lines 152*a*, 152*b* and 155*a*, 155*b*. The bottom wall panel 102 includes back slots 142*a*, 142*b* formed substantially on the lateral edge near the respective fold lines 128 and 130. The respective back slots 142*a* and 142*b* each of which is formed on the opposed side edges thereof in proximity of the back wall 106. The top wall panel 112 includes a tucked-in flap 114 that foldably extends from longitudinal free edge of the top wall panel. Furthermore, the top wall panel 112 includes two identical dust flaps 144*a* and 144*b* defined by fold lines 128, 130 and extend from its lateral edge. Each of the dust flaps 144*a*, 144*b* includes a respective dust locking tab 148*a*, 148*b* formed at its respective free edge. Two nicks 116 each of which is formed between the respective lateral edge of the dust flaps 144*a*, 144*b* and the respective second and fourth flanges 154*b*, 156*b*. When the blank 120 is in folded position, the respective dust locking tab 148*a*, 148*b* is inserted into the respective back slots 142*a*, 142*b*. The nicks 116 hold the respective dust flaps 144*a*, 144*b* aligned with the side wall panels 108*a*, 108*b* of the container. This feature of the invention permits the containers to nest and be column-stacked for storage prior to being used.

FIGS. 5A-5E illustrate the folding sequences of the blank shown in FIG. 4 for constructing the front-rollover and hammer lock container 100 in accordance to the present invention. It should be noted that the proper size and configuration (e.g., proportion) of these panels are important to construct into front, bottom, back, and top wall panels that are brought into juxtaposition with one another to form the front-rollover and hammer-lock container 100 as particularly depicted in FIGS. 5A & 5E.

Figure 5A:
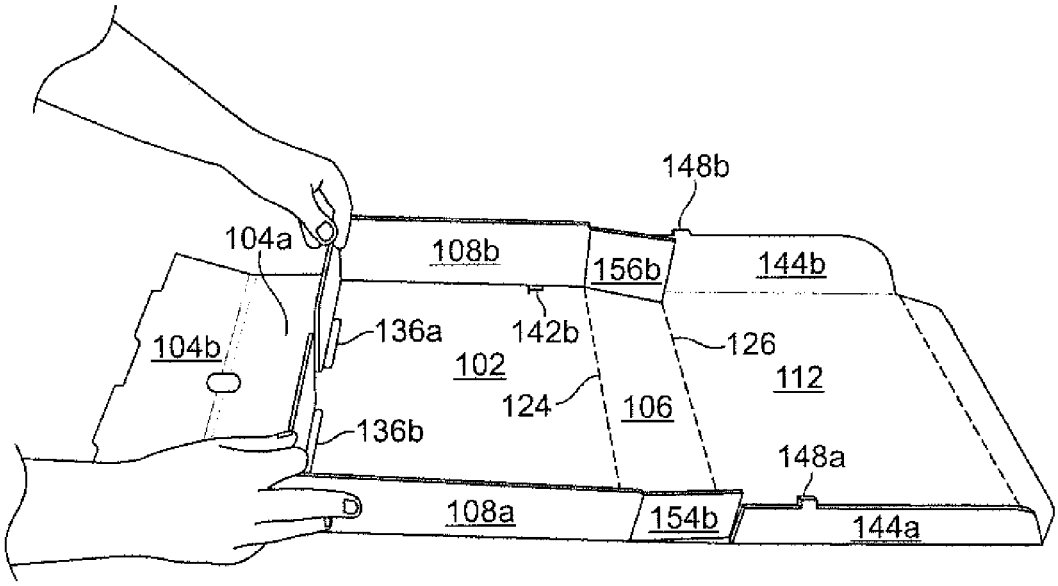
FIGS. 5A-5E illustrate the folding sequences of the blank shown in FIG. 4 for constructing the front-rollover and hammer-lock container in accordance to a preferred embodiment of the present invention.
Figure 5B:
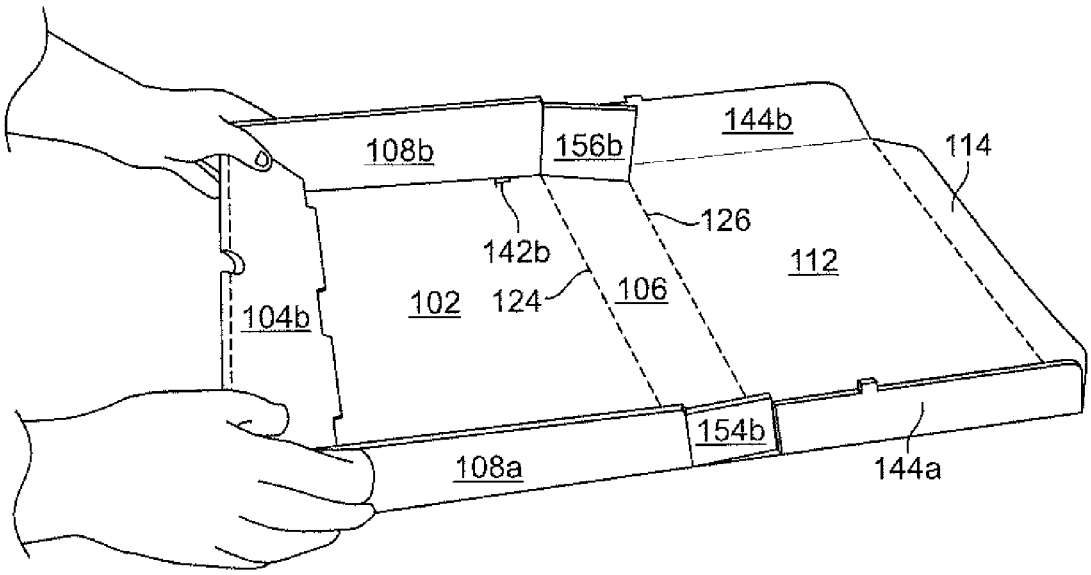
Figure 5C:
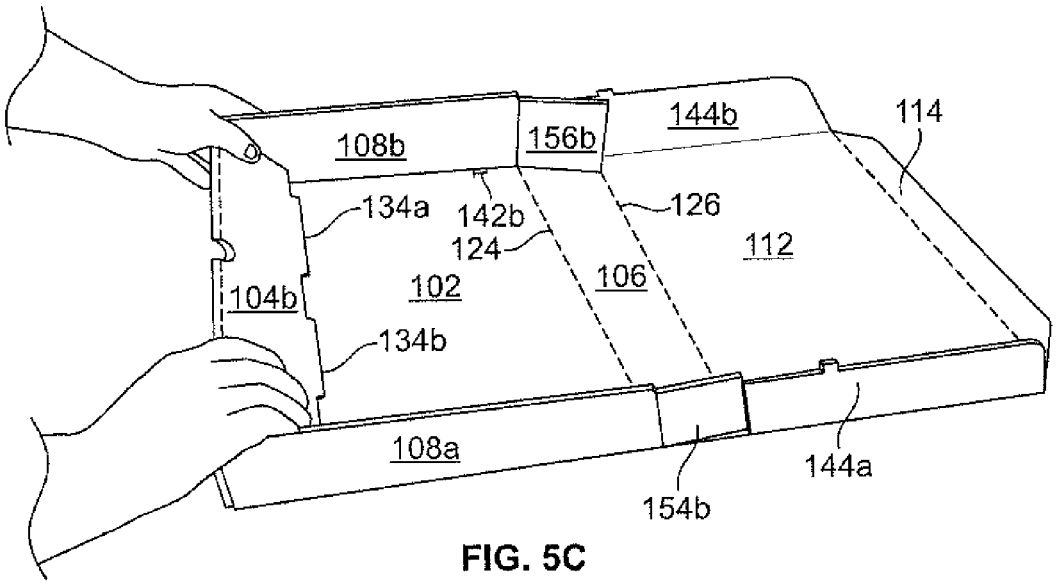
Figure 5D:
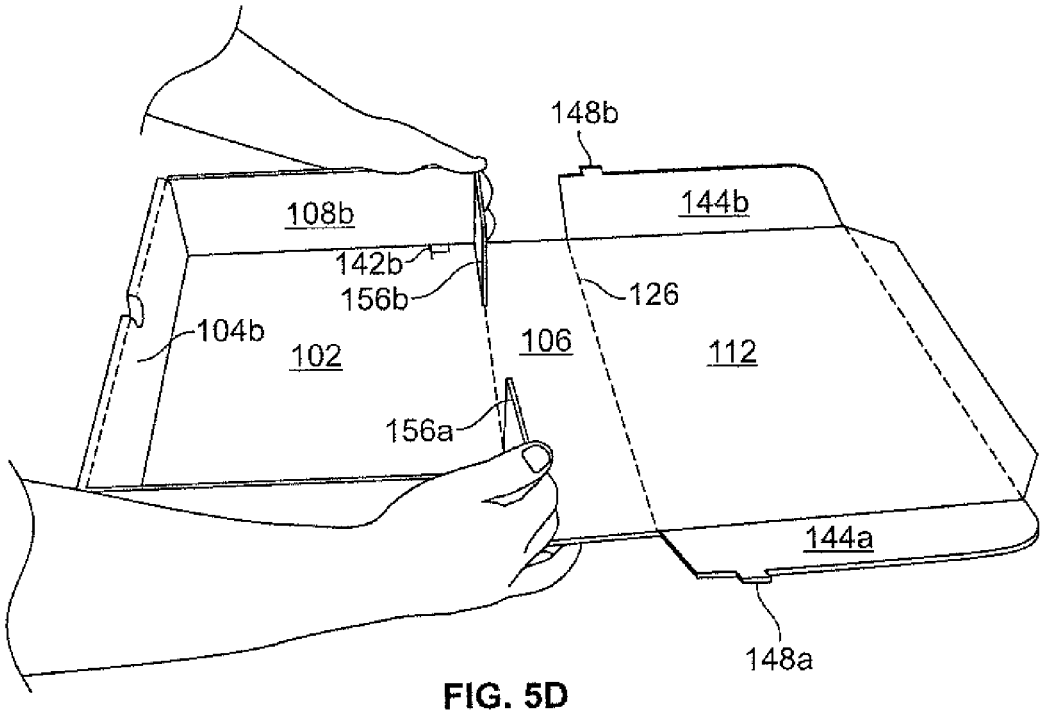
Figure 5E:
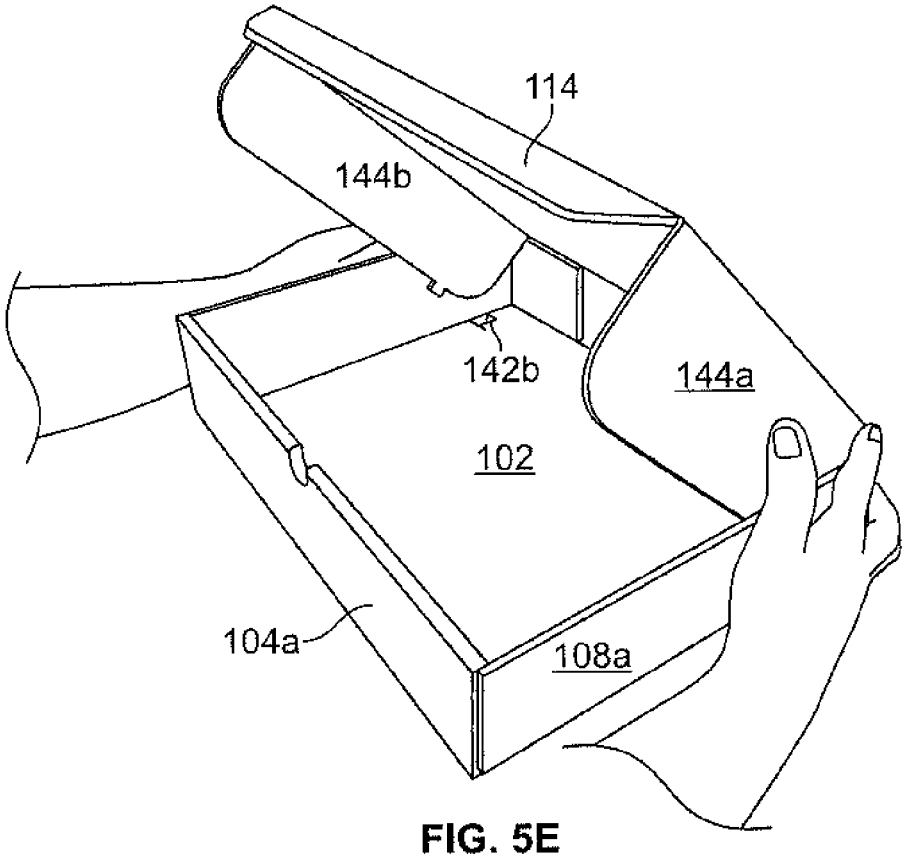
Figure 6:
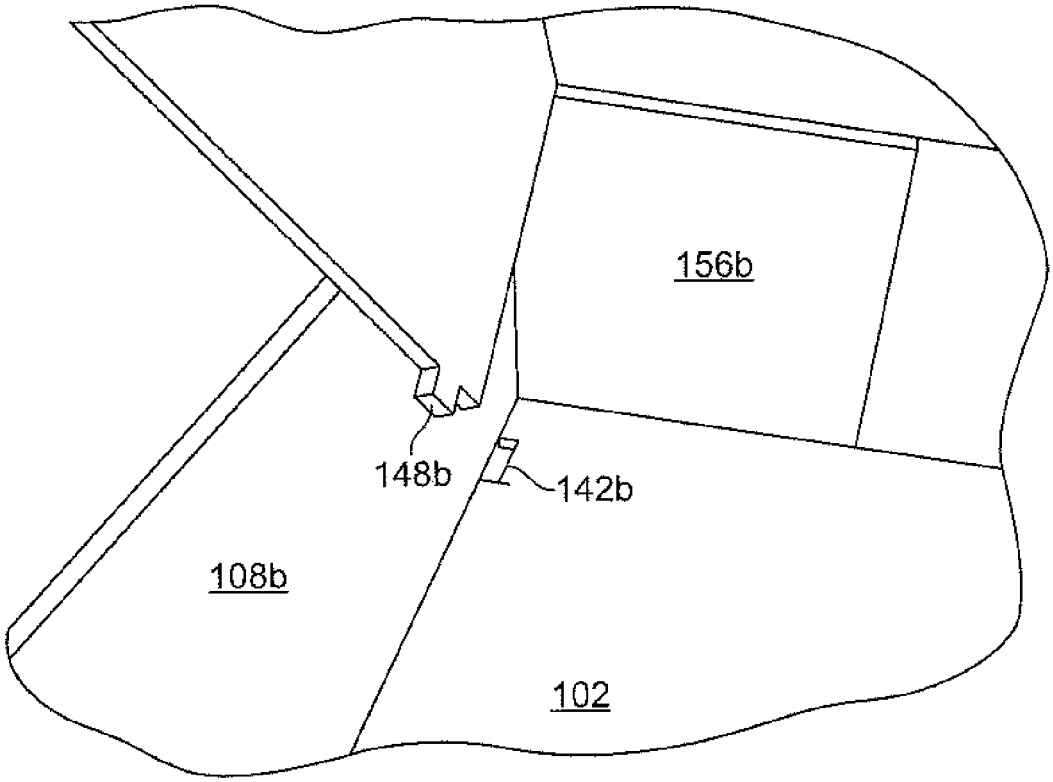
FIG. 6 is a fragmentary top perspective view of the container in FIG. 5E illustrating an enlarged view of a dust locking tab corresponding to a slot to be engaged thereto.

Referring to FIGS. 5A & 5E, manual set-up of the front-rollover and hammer-lock container 100 is easily accomplished. However, an ordinary skilled in the art would appreciate that generally a folding machine may alternatively perform the forming operations. The blank 100 is laid horizontally; the side wall panels 108*a*, 108*b* are folded upright along respective fold lines 128 and 130 to form the side walls 108*a*, 108*b*. Next, the two flanges 154*a*, 156*a* are folded toward one another at right angle with respect to fold lines 152*a*, 155*a*. Next, front wall panel 104*a*' is folded upright with respect to fold line 122 and the front wall panel 104*b*' is overlapped coextensively onto the front wall panel 104*a*' and then the front respective front locking tabs 134*a*, 134*b* are inserted into the respective front slots 136*a*. 136*b*. Next, the two flanges 154*b*, 156*b* are folded toward one another at right angle with respect to fold lines 152*b*, 155*b* and the back wall panel 106 is folded upright with respect to fold line 124. Next, the dust flaps 144*a*, 144*b* are folded uprightly along the respective fold lines 128, 130 as the top wall panel 112' through tucked-in flap 114' encloses front-rollover and hammer-lock container 100 when respective dust locking tab 148*a*', 148*b*' is inserted into the respective slots 142*a*', 142*b*'. As an example in FIG. 6, an enlarged view of the dust locking tab 148*b* corresponding to the slot 142*b* is shown to be engaged with one another. In use, the front-rollover and hammer-lock container 100 may contain variety of products, but not limited to, such as meat, poultry, electronic devices, condiments and/or produce since the container 100 has superior stackability when compared to prior art containers for similar goods and/or functions.

Figure 7A:
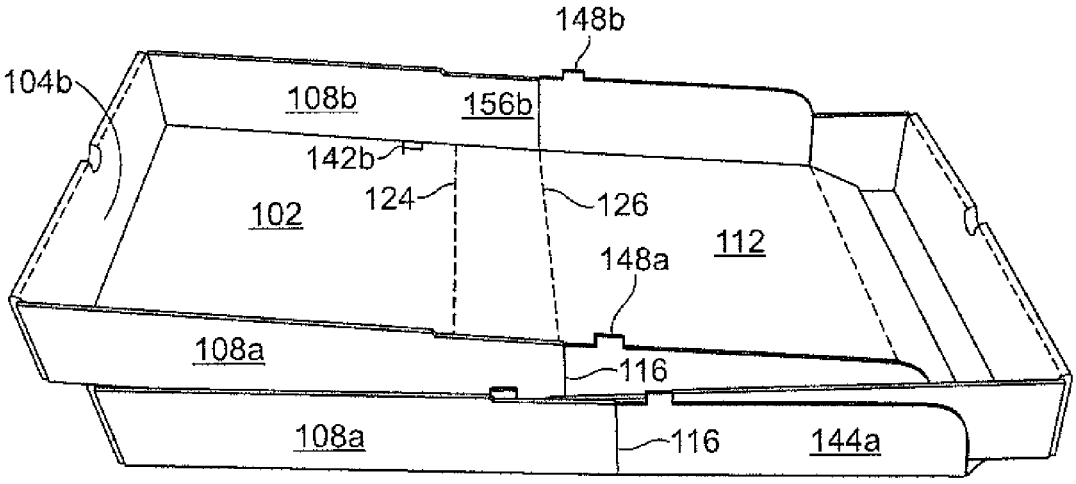
FIG. 7A is a top perspective view of the partially folded container constructed from the blank shown in FIG. 4 which illustrates the means to nest and column-stacked the partially folded container prior to be used.
Figure 7B:
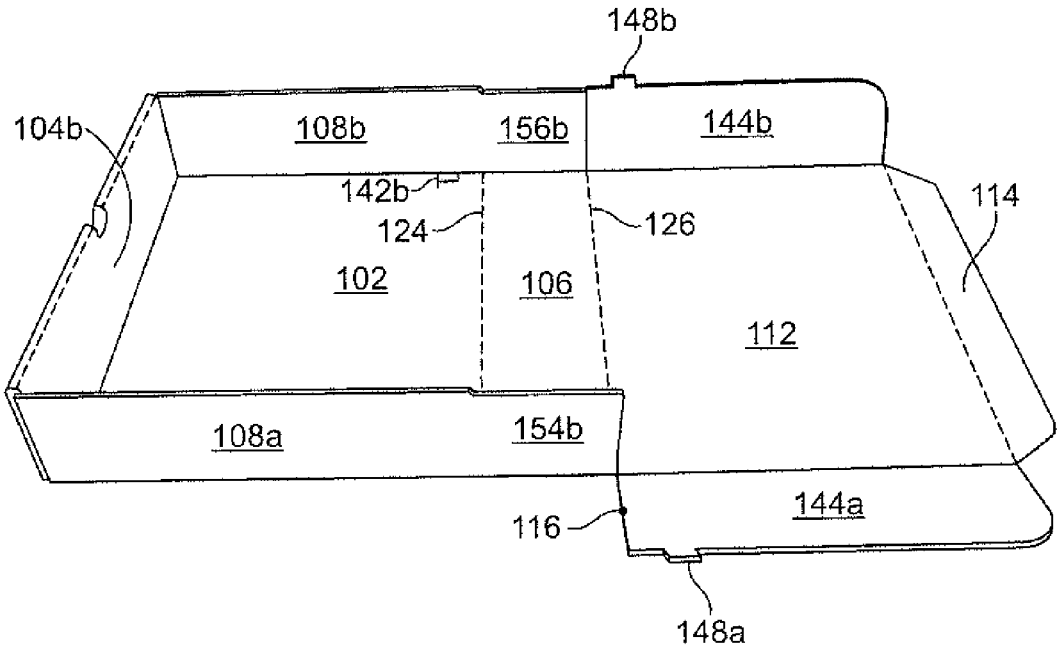
FIG. 7B is a top perspective view of one of the partially folded container constructed from the blank shown in FIG. 4 which illustrates a nick that hold the dust flap to the side wall.

FIG. 7A is a top perspective view of a partially folded container constructed from the blank 120 shown in FIG. 4 which illustrates means to nest and column-stacked the partially folded container 100 prior to be used. Prior to filling the container 100 with products, many users prefer that the partially folded containers to be capable of being column-stacked for storage purposes and therefore the respective dust flaps 144*a*', 144*b*' includes the nick 116 that is used to hold the dust flaps 144*a*', 144*b*' aligned with the side walls 108*a*, 108*b*. The respective nick 116 is formed between the respective lateral edge of the dust flaps 144*a*', 144*b*' and the respective second and fourth flanges 154*b*', 156*b*'.

Numerous modifications and variations on the present invention are possible in light of the above teachings. It is, therefore, to be understood that within the scope of the accompanying claims, the invention may be practiced otherwise than as specifically described herein. It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A front-rollover style and hammer-lock shipping container formed from a one-piece unitary blank of material, comprising a bottom wall foldably joined to upstanding opposed parallel side walls, a back wall, and a front wall to form an interior space, a top wall foldably joined to the back wall, the top wall panel includes two identical dust flaps each of which foldably extend from respective lateral edges thereof and wherein each of the dust flaps includes a respective dust locking tab formed at a respective free edge, the bottom wall comprises respective third and fourth slots each of which formed on respective opposed lateral edges in proximity of the back wall, each of the third and fourth slots includes a respective cut extension and a respective kink being extended from each of the third and fourth slots and wherein the respective third and fourth slots receive the respective dust locking tabs, each of the respective opposed parallel side walls includes respective first and second flanges and respective third and fourth flanges each of which extend from a respective lateral side thereof, the respective dust flaps and the respective opposed parallel side walls being attached to one another by two nicks each of which is formed between the respective lateral edge of the dust flaps and the respective second and fourth flanges so that partially folded containers to be capable of being column-stacked, the bottom wall comprises first and second front slots each of which formed on a longitudinal edge in proximity of the front wall, the front wall comprises two wall panels being coextensively in overlapping relationship with one another wherein one of the front wall panels includes two front locking tabs each of which being engaged with the corresponding first and second front slots when the container is fully constructed.

2. A one-piece unitary blank for making a container used for shipping one or more articles, the blank comprising a bottom wall panel having a front edge, a back edge, and opposite side edges defined by respective transverse and longitudinal fold lines, the bottom wall panel comprises two front slots and two back slots formed on respective front edge and side edges, each of the two back slots being formed on respective opposed lateral edges in proximity of the back wall, each of the two back slots includes a respective cut extension and a respective kink being extended from each of the two back slots a top wall panel having a front edge, a back edge and opposite side edges defined by respective transverse and longitudinal fold lines, the top wall panel comprises a pair of opposed dust flaps each of which foldably joined to respective lateral edges of the top wall, each of the dust flaps includes a respective dust locking tab formed at respective free edges thereof, the top wall further includes a tucked-in flap that foldably extends from longitudinal free edge thereof, a back wall panel foldably joined between the back edges of the bottom wall panel and the top wall panel, the respective dust flaps and the respective opposed parallel side walls being attached to one another by two nicks, a double front wall panels formed by two score lines, the double front wall panels includes a front edge, a back edge, and opposite side edges in which the back edge of the front wall panels being foldably joined to the bottom wall panel, one of the front wall panel (104*b*) includes two front locking tabs that extend from the free edge thereof and are spaced apart from one another, the respective front locking tabs are inserted into the respective front slots when the front wall panel (104*b*) is overlapped coextensively and in fully folded position with the front wall panel (104*a*) through the two parallel score lines.

* * * * *